United States Patent [19]

Caldwell et al.

[11] Patent Number: 5,025,865

[45] Date of Patent: Jun. 25, 1991

[54] SUBSEA OIL PRODUCTION SYSTEM

[75] Inventors: Trevor D. Caldwell, Woking; Carlos Villanueva, Harpenden, both of England

[73] Assignee: The British Petroleum Company p.l.c., London, England

[21] Appl. No.: 102,366

[22] Filed: Sep. 29, 1987

[30] Foreign Application Priority Data

Oct. 4, 1986 [GB] United Kingdom ..... 8623900

[51] Int. Cl.[5] ..... E21B 43/017

[52] U.S. Cl. ..... 166/366; 166/339; 166/341; 166/347; 166/360; 166/368; 405/211

[58] Field of Search ..... 166/366, 368, 336, 339, 166/244, 347, 356, 360, 365; 405/195, 211

[56] References Cited

U.S. PATENT DOCUMENTS

| | | | |
|---|---|---|---|
| 3,877,520 | 4/1975 | Putnam | 166/366 |
| 4,120,362 | 10/1978 | Chateau et al. | 166/366 X |
| 4,192,383 | 3/1980 | Kirkland et al. | 166/341 |
| 4,194,857 | 3/1980 | Chateau et al. | 166/339 X |
| 4,378,848 | 4/1983 | Milberger | 166/366 X |
| 4,437,521 | 3/1984 | Richardson et al. | 166/366 X |
| 4,438,817 | 3/1984 | Pokladnik et al. | 166/366 X |
| 4,625,805 | 12/1986 | Ladecky | 166/360 X |
| 4,625,806 | 12/1986 | Silcox | 166/368 X |
| 4,732,215 | 3/1988 | Hopper | 166/366 |

*Primary Examiner*—Stephen J. Novosad

*Attorney, Agent, or Firm*—Morgan & Finnegan

[57] ABSTRACT

A subsea oil and/or gas production system comprises a template having a three-dimensional framework enclosing one or more production bays, each bay having a well slot and a manifold slot. The space above the well slot is occupied by a tree module fitted with a high pressure cap. The space above the manifold slot is occupied by a manifold header module positioned on the template and forming the base of the equipment in the area of the manifold slot(s), isolation valve module(s) positioned adjacent to the manifold header module and connected thereto, flow control modules(s) positioned adjacent to the isolation valve module(s) and connected thereto, production choke module(s) positioned adjacent to the flow control module(s) and connected thereto, and production control pod(s) positioned adjacent to the flow control modules(s) and connected thereto. The tree module(s) are connected to the flow control module(s). Individual modules can be disconnected and retrieved to the surface for repair or replacement of components.

12 Claims, 3 Drawing Sheets

SUBSEA OIL PRODUCTION SYSTEM

Figure 1:
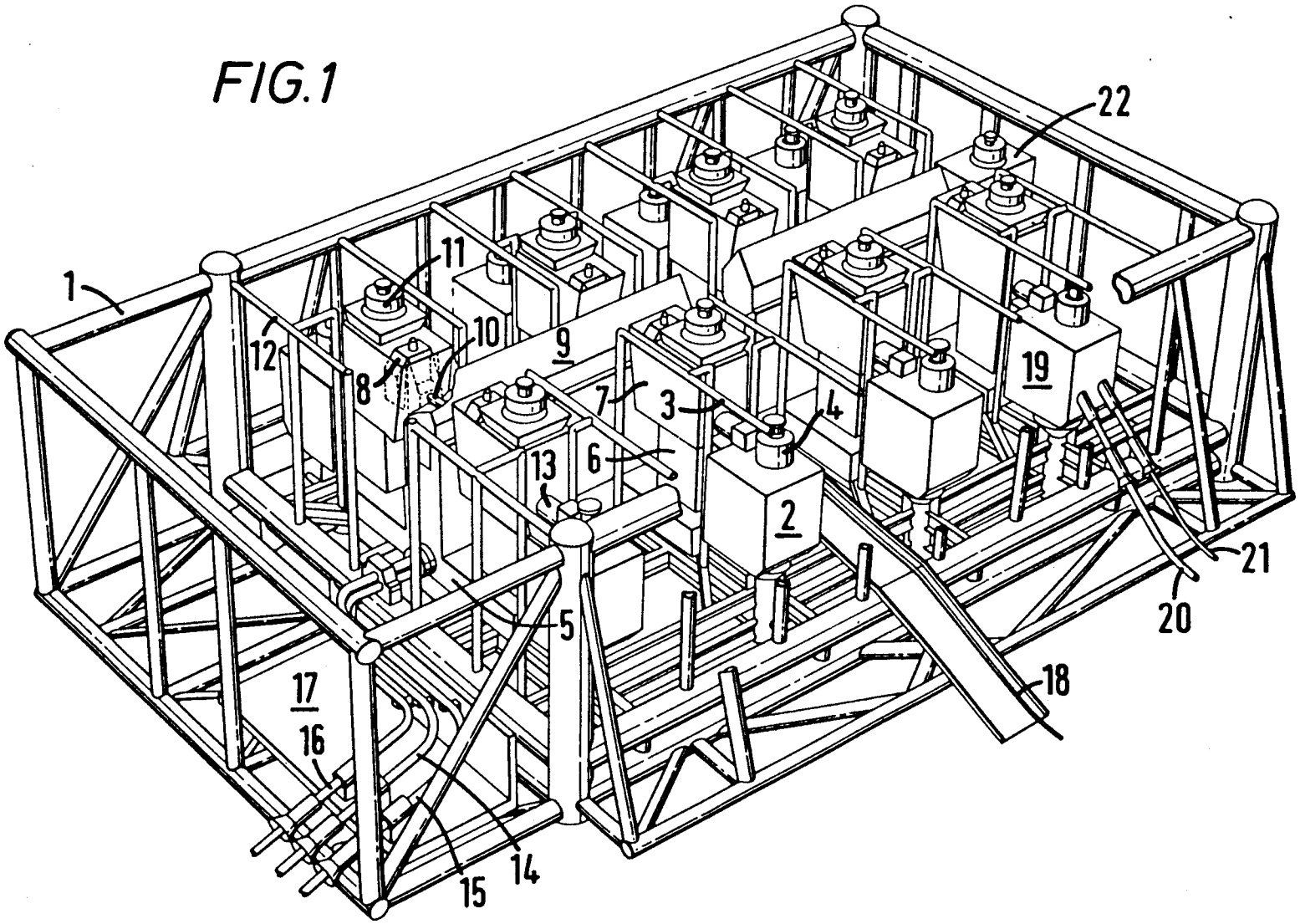

This invention relates to a modular subsea oil and/or gas production system using a template.

A considerable proportion of the world's remaining oil and gas reserves is believed to lie offshore under water depths in excess of 200 metres, in relatively small oil and/or gas fields, and in hostile environments. As any one of these conditions intensifies, and more particularly when two or more are present together, the cost of conventional offshore recovery systems, wherein drilling and production facilities are mounted on the decks of free standing platforms, rises rapidly and soon becomes uneconomic.

For this reason attention has been given to subsea production systems where a favoured technique is to drill a number of locational wells close together and to mount the well control and production equipment on the sea bed. In order to do this, a structure known as a template is employed. In essence this is a large frame with guide tubes for drilling which is deposited and secured on the sea bed in a desired location. After drilling, well control and production equipment are mounted on the frame and these facilities remain on the sea bed.

Although remotely operated vehicles (ROVs) are known for inspecting, testing and servicing the production systems, water depths, up until now, have nearly all been such that the systems have been accessible to divers.

As the water depths in which oil and/or gas is found and produced increase, totally diverless systems will be needed. Even in shallower depths, however, diverless systems could be economically attractive.

The well control and production equipment is generally located in position using guidelines, but it may also be necessary or desirable to dispense with guidelines, depending on the depth of water and choice of intervention vessel. As depth increases, the guidelines become heavier and more powerful winches are required to deploy them.

We have now devised a modular subsea oil and/or gas production system in which the components are located within modules which are self locating and thus guidelines are unnecessary.

Thus according to the present invention there is provided a subsea oil and/or gas production system comprising:

(a) a template having a three-dimensional framework enclosing one or more production bays, each bay having a well slot and a manifold slot, the space above the well slot being occupied by (b) a tree module fitted with (c) a high pressure cap, the space above the manifold slot being occupied by (d) a manifold header module positioned on the template and forming the base of the equipment in the area of the manifold slot(s), (e) isolation valve module(s) positioned adjacent to the manifold header module and connected thereto, (f) flow control module(s) positioned adjacent to the isolation valve module(s) and connected thereto, (g) production choke module(s) positioned adjacent to the flow control module(s) and connected thereto, and (h) production control pod(s) positioned adjacent to the flow control module(s) and connected thereto, the tree module(s) being connected to the flow control module(s) preferably by means of multibore horizontal connector(s).

When more than one production bay is present, the bays are spaced apart and preferably placed side by side in a row, or in two mirror-image rows in the case of larger systems.

One or more of the tree modules may be replaced by a satellite connection module to accommodate production from a satellite well located some distance from the template, e.g. about 3 km.

The system preferably contains in addition (i) a control distribution module positioned adjacent to the production control pod(s) and connected thereto and (j) a pigging cross-over module positioned adjacent to the manifold header module and connected thereto.

The manifold header module will generally comprise outlets for test and production fluids and an inlet for water injection.

Preferably (k) a flowline expansion module is positioned adjacent to the manifold header module and the outlets and inlets are connected to it. The flowline expansion module compensates for the expansion of flowlines carrying hot production fluids during start-up and their contraction on shut-down.

The design basis provides for modules interconnected by vertical and/or horizontal multi-bore process and/or control connectors, which modules can be retrieved to the surface for repair or replacement of components without guidelines. The tree, production choke, flow control and isolation valve modules and production control pods are configured to permit the easiest retrieval of the least reliable modules. It is envisaged that the production choke modules and the production control pods will require retrieval more frequently that the other modules and therefore by utilising various arrangements of vertical and horizontal connectors these modules can be retrieved without removing other modules.

The flow control module is preferably positioned above the isolation valve module and the production choke module above the flow control module.

Also through the use of horizontal connectors the tree modules can be retrieved without removing any of the modules in the manifold slot and similarly modules in the manifold slot can be retrieved without removing the tree modules.

The system is suitable for oil and/or gas production, with or without water injection, subject to field requirements. It may be modified for gas lift and chemical injection if desired.

The system assumes control of individual wells by chokes with pressure and position monitoring on the template and with commingled export of well streams back to a processing platform facility perhaps 10 km distant.

For ease of location, and also for protection, the modules and production control pod should be surrounded by guides, suitably in the form of rectangular open frameworks.

In order to interact with other modules, the modules should have chamfered external corners extending to or near the base dimensioned to fit into the appropriate location.

Some or all of the modules may have a rectangular portion below the chamfered portion of the base.

The chamfered external corners give the base of each module to which they are fitted the form of an inverted pyramid. This fits into the rectangular framework of the unit below. The latter framework may contain further structural members, e.g. chamfered internal corners or sloping central members which take the form of a hollow inverted pyramid of complementary dimensions to the base of the module directly above it.

It will be noted that the guiding frameworks may form part of the structure of the modules, with the exception of the framework below the tree module, and need not be part of the template structure.

Preferably they are surrounded by a protective cage which is, in fact, part of the template structure.

The modules and control pods will generally be deployed from a dynamically positioned support vessel (DSV) by suspending them from a running tool and a remotely guided vehicle (RGV) which will manoeuvre horizontally until the module to be deployed is in the correct position above the template. The module will then be lowered for engagement with the guide means on the base of the template or a previously positioned module.

It is most unlikely that perfect alignment will be achieved immediately in which each module slips into place. It is probable that initially there will be at least a slight rotational and lateral misalignment. However, the weight of each module acting on the chamfered corners causes it to twist and self-align until the vertical connector at the base of the module engages with its mating mandrel on the template or previously positioned module.

During a module retrieval operation an appropriately designed running tool may be used to self-align with a module, prior to disengaging the module from the base or other module.

In the case of a multi-well system, the space between the production bays permits the entry of a free swimming remotely operated vehicle (ROV) into the system for intervention purposes.

Figure 2:
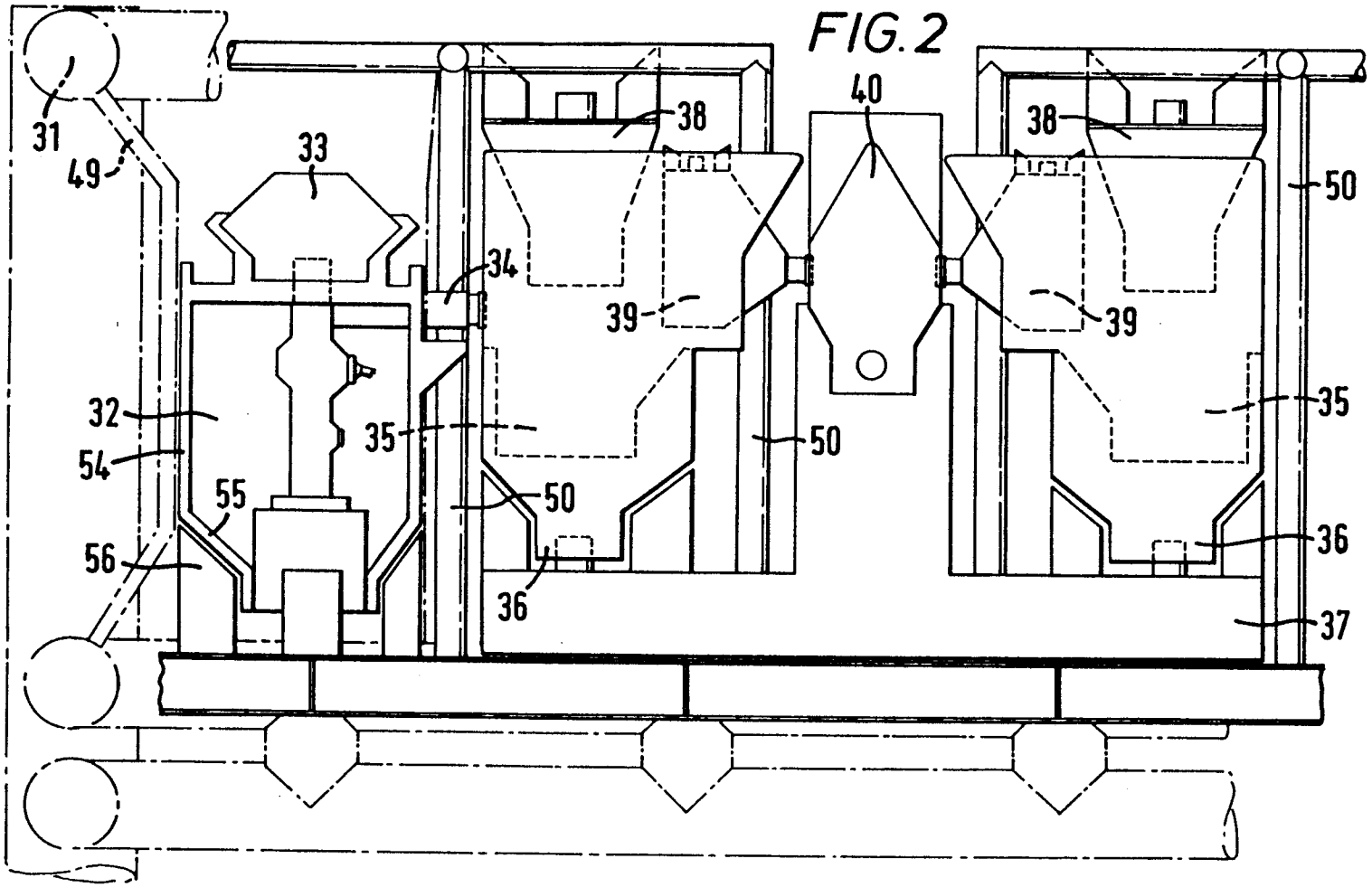
Figure 3:
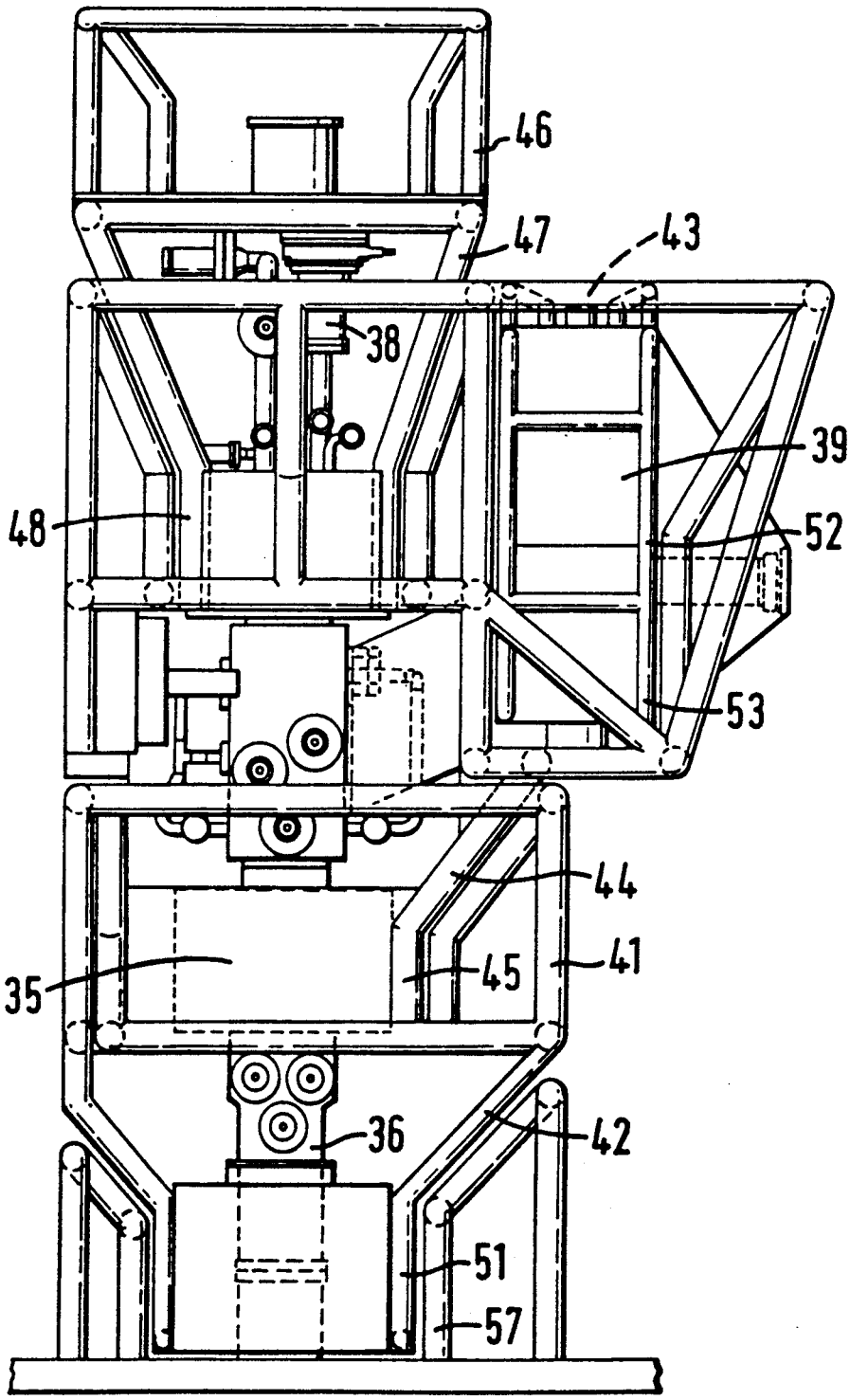

The invention is illustrated with reference to FIGS. 1-3 of the accompanying drawings wherein FIG. 1 is a perspective view of a two-row, eight-well subsea production system, FIG. 2 is a schematic end elevation of the system and FIG. 3 is an end elevation of the modules above the manifold header module. FIG. 1 is a schematic diagram and is primarily intended to indicate the relative positions of the various modules. The shapes in this drawing do not necessarily correspond to the shapes of the modules illustrated in FIGS. 2 and 3.

With reference to FIG. 1, the system comprises a template formed by a main rectangular frame 1. The frame contains spaces for two rows, each containing four production bays. Each bay consists of a well slot and a manifold slot, over which the equipment to be described is fitted.

Above the well slots are fitted tree modules 2 surrounded by protective cages 3 and fitted with high pressure caps 4.

A manifold header module 5 is located on the template and covers the manifold slots. Above the manifold header module 5 and connected to it are isolation valve modules 6 and above the isolation valve modules 6 and connected to them are flow control modules 7. Adjacent to the flow control modules 7 and connected to them are production control pods 8 which in turn are connected to a control distribution module 9. For ease of retrieval, the control pods 8 are connected to the flow control modules 7 by vertical connectors (not shown)and to the control distribution module 9 by horizontal connectors 10. Above the flow control modules 7 and connected to them are production choke modules 11. Items 6, 7, 8 and 11 are surrounded by protective cages 12.

Tree modules 2 are connected to flow control modules 7 by means of horizontal multi-bore connectors 13.

Produced fluids are taken from the system by means of test and production flowlines 14 and 15, respectively, through the manifold header module 5 which collects production from the wells. Water may be injected into the wells by means of the water injection line 16. Lines 14, 15 and 16 are connected to a flowline expansion module 17.

Power to the production control pods 8, which may be hydraulic, electric or both, is supplied via an umbilical 18 to the control distribution module 9 and thence to the production control pods 8.

Chemicals for injection into the produced fluids are routed through the umbilical 18, the control distribution module 9, the production control pods 8 and thence into the flow control modules 7.

In order to accommodate a satellite well situated at some distance from the template, one of the trees is replaced by a satellite connection module 19. Production from or water injection to a well is routed through flowline 20 and hydraulic and/or electrical power and chemicals for injection are supplied to a well through umbilical 21.

The production flowline 15 may be pigged by means of the water injection flowline 16 and a pigging crossover module 22.

With reference to FIGS. 2 and 3, the system comprises a main rectangular frame 31. This contains a tree module 32 above which is a high pressure tree cap 33. Production from the tree module 32 flows by way of a horizontal multi-bore connector 34 to a flow control module 35. Production then passes into a production choke module 38 before returning to the flow control module 35 and then passing through the isolation valve module 36 into a manifold header module 37. The production choke module 38 fits into the flow control module 35. The flow control module 35 fits into the isolation valve module 36 and the production control pod 39 fits into the flow control module 35.

With water for injection the flow direction is reversed and comes from the manifold header module 37 to the tree module 32.

Valves and sensors contained with the various modules are controlled by a production control pod 39 supplied by a control distribution module 40.

The isolation valve module 36 is surrounded by a rectangular framework 41 which is fitted at its base with externally chamfered corners 42 which locate with a rectangular framework 57 on the manifold header module 37. The framework 41 has a rectangular section 51 below the corners 42. The flow control module 35 is surrounded by a rectangular framework 43 which is fitted near its base with externally chamfered corners 44 which locate with corners of the framework 41. The framework 43 has a rectangular section 45 below the corners 44.

The production choke module 38 is surrounded by a rectangular framework 46 which is fitted with externally chamfered corners 47 which locate with corners of the framework 43. The framework 46 has a rectangular section 48 below the corners 47.

The production control pod 39 is surrounded by a rectangular framework 52 which is fitted at its base with externally chamfered corners 53 which locate with corners of the framework 43.

The tree module 32 is surrounded by a rectangular framework 54 which is fitted at its base with externally chamfered corners 55 which locate with a rectangular framework 56 located on the template.

The modules are surrounded by protective cages 49 and 50.

We claim:

1. A subsea oil and/or gas production system comprising:

(a) a template having a three-dimensional framework enclosing one or more production bays spaced apart, each bay having a well slot and a manifold slot, the space above the well slot being occupied by (b) a tree module fitted with (c) a high pressure cap, the space above the manifold slot being occupied by (d) a manifold header module positioned on the template and forming the base of the equipment in the area of the manifold slot(s), (e) isolation valve module(s) positioned adjacent to the manifold header module and connected thereto, (f) flow control module(s) positioned adjacent to the isolation valve module(s) and connected thereto, (g) production choke module(s) positioned adjacent to the flow control module(s) and connected thereto, and (h) production control pod(s) positioned adjacent to the flow control module(s) and connected thereto, the tree module(s) being connected to the flow control module(s).

2. A subsea oil and/or gas production system according to claim 1 wherein the tree module(s) are connected to the flow control module(s) by means of multibore horizontal connector(s).

3. A subsea oil and/or gas production system according to claim 1 further comprising a control distribution module positioned adjacent to the production control pod(s) and connected thereto for the supply of hydraulic and/or electrical power.

4. A subsea oil and/or gas production system according to claim 1 wherein the manifold header module comprises outlets for test and production fluids, and an inlet for water injection.

5. A subsea oil and/or gas production system according to claim 4 wherein the outlets and the inlet are connected to a flowline expansion module.

6. A subsea oil and/or gas production system according to claim 1 further comprising a pigging cross-over module positioned adjacent to the manifold header module and connected thereto.

7. A subsea oil and/or gas production system according to claim 1 wherein the flow control module(s) are positioned above the isolation valve module(s) and the production choke module is positioned above the flow control module.

8. A subsea oil and/or gas production system according to claim 7 wherein the modules comprise guide means which interact with the base of the module above.

9. A subsea oil and/or gas production system according to claim 1 wherein the template comprises guide means at the base of the template for the tree module(s).

10. A subsea oil and/or gas production system according to claim 8 wherein the guide means are in the form of rectangular open frameworks.

11. A subsea oil and/or gas production system according to claim 1 wherein the modules are surrounded by a protective cage which is part of the template structure.

12. A subsea oil and/or gas production system according to claim 1 wherein one or more of the tree modules is replaced by a satellite connection module.

* * * * *